US005328658A

United States Patent [19]

Egawa et al.

[11] Patent Number: 5,328,658

[45] Date of Patent: Jul. 12, 1994

[54] METHOD OF REFINING CHROMIUM-CONTAINING STEEL

[75] Inventors: Osamu Egawa; Yoshihiro Naito; Hitoshi Sakuma, all of Shibukawa, Japan

[73] Assignee: Daido Tokushuko Kabushiki Kaisha, Nagoya, Japan

[21] Appl. No.: 101,730

[22] Filed: Aug. 4, 1993

[51] Int. Cl.[5] ..... C21C 7/10; C21C 5/34

[52] U.S. Cl. ..... 420/71; 75/528; 75/554

[58] Field of Search ..... 75/528, 554; 420/71

[56] References Cited

U.S. PATENT DOCUMENTS

| | | | |
|---|---|---|---|
| 3,046,107 | 7/1962 | Nelson | 75/554 |
| 3,252,790 | 5/1946 | Krivsky | 75/554 |
| 3,850,617 | 11/1974 | Umowski | 420/71 |
| 3,867,134 | 2/1975 | Shaw | 75/554 |
| 3,947,267 | 3/1976 | d'Entremont | 420/71 |
| 4,174,212 | 11/1979 | Bauer | 420/71 |
| 4,178,173 | 11/1979 | Gorges | 420/71 |
| 4,474,605 | 10/1984 | Masuda | 420/71 |

*Primary Examiner*—Peter D. Rosenberg
*Attorney, Agent, or Firm*—Varndell Legal Group

[57] ABSTRACT

A refining method of decarburizing a molten steel containing a large quantity of chromium, which can be completed in a shorter period, and therefore, with reduced consumption of Ar gas, and with safety of operation. A mixed gas of $O_2$ and Ar is blown into a molten steel in a refining vessel through a tuyere at the bottom of the vessel under atmospheric pressure, and when the C-concentration becomes to such a low level as 0.15% (by weight) or less, vacuum suction is applied to reduce the pressure to 150–200 Torr, and only Ar gas is blown. At the change of the refining conditions from atmospheric to vacuum or during the vacuum refining a reducing agent such as ferrosilicon is added to the molten steel to reduce Cr-oxides for recovery. Even if the amount of the reducing agent is less than that necessary for reducing all the Cr oxides, majority of Cr can be recovered. If an excess amount is used, a steel of low nitrogen in addition to low carbon is obtained.

Whole or a portion of Ar can be replaced with $N_2$. Refining may be carried out economically when compared with conventional refining method such as AOD process by reducing At-consumption. It is possible to obtain a steel containing desired nitrogen by changing the blown gas from $N_2$ to Ar and choosing the timing of changing depending on the desired N-concentration.

5 Claims, 5 Drawing Sheets

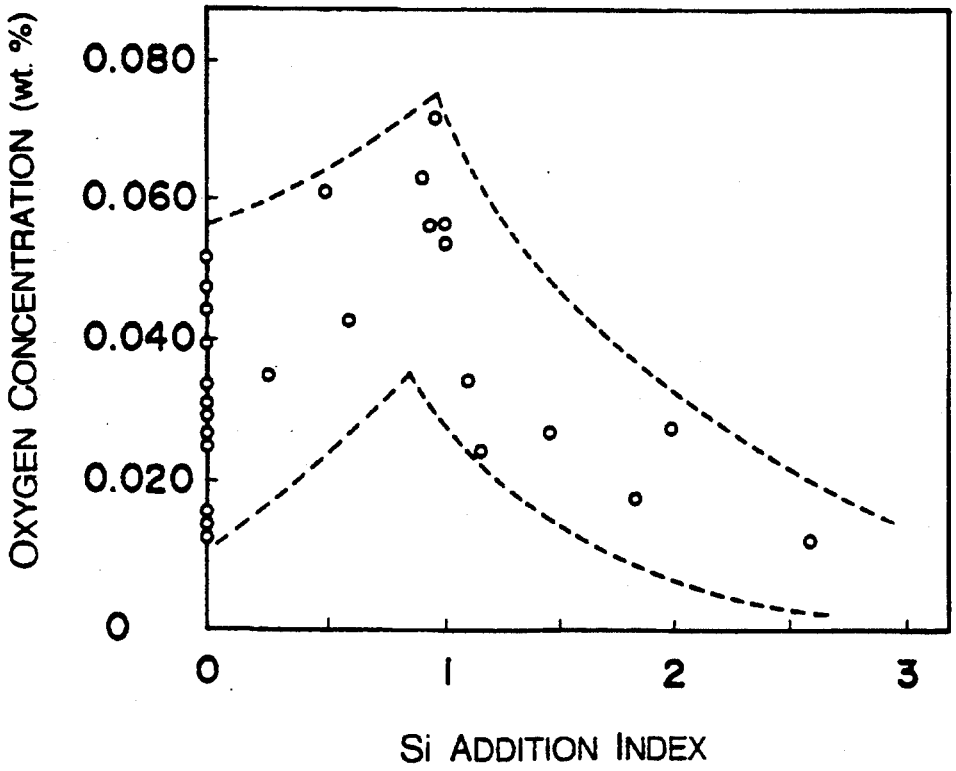
FIG. 3
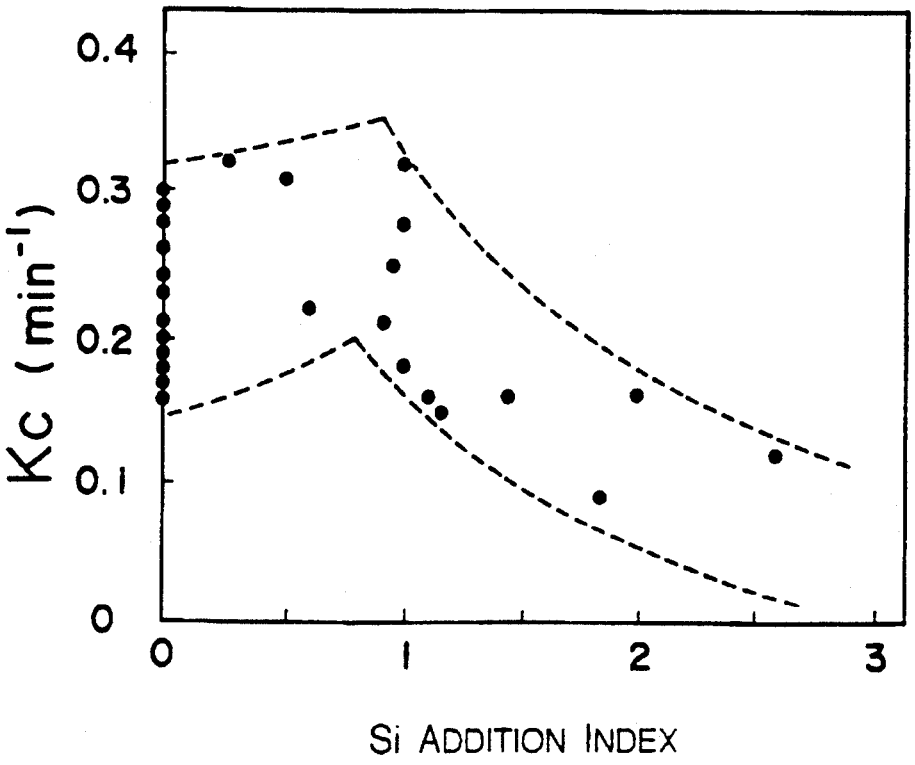

METHOD OF REFINING CHROMIUM-CONTAINING STEEL

BACKGROUND OF THE INVENTION

1. Field of the Invention

The present invention concerns a method of refining a steel with a high chromium content by decarburizing it to a very low carbon content. By the present method it is possible to produce a high chromium steel with a low carbon content and a low nitrogen content in a short period of time. The method is also suitable for producing a chromium-containing steel with a nitrogen content regulated into a certain range.

The chromium-containing steels to which the present method can be applied are those of chromium content of 5% or higher, and examples thereof are Ni-Cr base stainless steels and Cr-base stainless steels.

2. State of the Art

In the AOD process which is widely practiced as a decarburization method of chromium-containing steel, chromium is easily oxidized when decarburization proceeds and carbon content becomes low. Then, Ar to oxygen ratio in the gas blown into the molten steel is increased so as to decrease loss of chromium. When the carbon content in the molten steel becomes to a certain low level a reducing agent such as ferrosilicon is charged and only argon is blown into the molten steel to stir it so that the chromium oxides occurred in the molten steel during the refining process so far may be reduced and recovered. Thus, there is obtained a molten steel with the carbon content lowered to a predetermined level and the chromium content of the level prior to the refining.

However, in the lower carbon range decarburization rate becomes so low that it takes long time to achieve the desired carbon content, and moreover, oxidation of chromium tends to proceed. To suppress oxidation of chromium it is necessary to increase the proportion of argon gas in the blown gas. This causes increase in consumption of argon gas, and the process becomes ineconomical.

It is practiced to use $N_2$ gas, which is also non-oxidizing, instead of argon gas. This could be applied only to the refining of some limited steels.

Whichever of argon gas or nitrogen gas is used as the non-oxidizing gas, it is helpful to utilize vacuum refining as the way to promote decarburization at the low carbon range. For example, in the method described in U.S. Pat. No. 4,174,212 for the purpose of refining a high chromium stainless steel to such a low carbon content as 0.03% or less decarburization under atmospheric pressure with oxygen is carried out to achieve a carbon content as low as 0.4–0.2%, and thereafter, stirring with the non-oxidizing gas is continued and blowing of $O_2$ is interrupted, and the pressure above the molten metal bath is continuously lowered to about 10 Torr or less so that boiling of the molten metal may occur, and thus, the desired decarburization is achieved. The refining method disclosed in Japanese Patent Disclosure No. 61-136611 adopts a similar process. In the method decarburization using an AOD device is carried out under atmospheric pressure, and then a vacuum refining device is used to continue decarburization under a reduced pressure of 20 Torr.

Development and proposal of further improved methods were made. In one of such methods decarburization is carried out to a carbon level of about 0.2% under atmospheric pressure by blowing a mixed gas of non-oxidizing gas such as argon gas and oxygen, and then, under the condition of such a reduced pressure as 200 Torr blowing of a non-oxidizing gas such as argon gas is continued to lower the carbon concentration. Another method includes, in furtherance to the above process, addition of reducing agent at the above vacuum refining for the purpose of reducing all the chromium which was oxidized during the preceding steps and thus achieving simultaneous decarburization and reduction of chromium oxides.

Generally, in refining chromium-containing molten steel where the formed chromium oxides are reduced with a reducing agent such as ferrosilicon, the ration $W_o/W$, wherein $W_o$ stands for practical addition amount of the reducing agent and W for a theoretical amount of reducing agent necessary for reducing all the chromium oxides, is referred to as "Si-addition index". If a chromium-containing molten steel of a carbon content "$C_o$" (weight %) is refined under vacuum for the period "t" (minutes) to lower the carbon content to "$C_l$", the following relation is held:

$$C_1/C_o\ e^{-Kc.t}$$

wherein Kc is a constant referred to as "decarburization reaction volume coefficient", which is expressed by the formula below:

$$Kc=(l/t)\ ln\ (C_1/C_o)$$

and indicates easiness of the decarburization reaction in the vacuum refining.

Also, if nitrogen content before the vacuum refining is expressed with "$N_o$" (weight %) and that after vacuum refining for a period of "t" (minutes) with "$N_1$", the value "$K_N$" expressed by the formula:

$$K_N=(l/t)\ ln\ (l/N_1-l/N_0)$$

is referred to as "denitration reaction volume coefficient", which indicates easiness of denitration reaction in the vacuum refining.

We carried out the above described refining on a chromium-containing steel of nitrogen content 0.15 wt. % and chromium content 17.2 wt. % by, after adding reducing agent with various Si-addition indices, blowing argon under a vacuum of 200 Torr at a rate of 0.3 $Nm^3$/min.ton-steel for 10 minutes, and measured at various Si-addition indices oxygen contents, carbon contents and nitrogen contents in the produced molten steel.

The results are shown in FIG. 2 as the relation between the oxygen content and Si-addition index; and in FIG. 3 and FIG. 4 as the relations between the decarburization reaction volume coefficient and the Si-addition index, and between the denitration reaction volume coefficient and the Si-addition index. As seen from these Figures, oxygen content is the chromium-containing molten steel shows a particular behavior at a Si-addition index around 1.0, and the value of Kc changes from large to small. On the other hand, KN shows little changes until the Si-addition index reaches 1.0, but shows a tendency to increase thereafter.

Based on this knowledge, we made further research on the relation between timing of adding Si-based reducing agent and the amount of addition to the chromium-containing molten steel described above, and discovered the facts that, according to the method explained later, carbon content in the steel may be lowered to 0.01% or less and that nitrogen content may be lowered to 0.02% or so.

In the above described refining method, if argon gas is used as the non-oxidizing gas, the N-content in the molten steel could be lowered to about 0.02%. However, depending on the kind of steels a higher N-content may be sometimes rather preferable. In case where the N-content is to be regulated to a certain value in the range of 0.03 0 0.10%, blowing only argon gas may result in an unnecessarily low N-content and may necessitate nitration step later. This causes, as the result, dissipation of expensive argon gas.

In the method described above (U.S. Pat. No. 4,174,212 or Japanese Patent Disclosure No.61-136611) which is a combination of atmospheric refining and vacuum refining, supply of 02 is stopped at a relatively high C-content, and as the consequence, loss of Cr by oxidation is not significant. However, sudden application of vacuum causes generation of large amount of CO gas which may bring about danger of explosion. The danger may be lightened if vacuum suction is slowly carried out. On the other hand, however, much longer period is spent for the process and another problem occurs, i.e., the molten bath temperature decreases and reaction becomes slow. Such a lower operating pressure as 10 Torr or less causes vigorous splashing of the molten steel, and this may result in plugging of hoppers for charging alloying elements. Thus, it is practically not operable to add reducing agent for recovering Cr from oxides thereof at the same time as the final decarburization step. Cr-recovery can be done by addition of reducing agent after completion of the decarburization, bu the period for the refining is prolonged.

SUMMARY OF THE INVENTION

The first and the major object of the present invention is to provide a steel refining method which can produce a chromium-containing steel with extremely low carbon and extremely low nitrogen, and further, the concentrations of carbon and nitrogen can be controlled.

The second and the major object of this invention is to provide a steel refining method which can, with reduced consumption of expensive argon gas, produce a chromium-containing steel of a certain nitrogen content.

The additional object of the invention is to provide a refining method in decarburization of chromium-containing molten steel, in which promotion of decarburization by applying vacuum is carried out in such a moderate rate that no danger of explosion caused by generation of a large volume of CO gas is brought about and that molten steel splashing is suppressed to the extent of practically no harmful influence, and thus, to complete Cr-recovery by addition of reducing agent simultaneously with the final decarburization.

The method of refining chromium-containing molten steel according to the present invention which achieves the above mentioned first and major object and the additional object comprises decarburization in which gases are blown into the chromium-containing molten steel in a refining vessel through a tuyere installed at the bottom of the refining vessel, and has the following three embodiments.

The first embodiment comprises: decarburizing by blowing mixed gas of a non-oxidizing gas and oxygen as the blowing gas under atmospheric pressure until the carbon concentration in the molten steel decreases to 0.15% (by weight), and after the carbon concentration decreased below this value, adding a reducing agent in the theoretical amount necessary for reducing chromium oxides in the molten steel or less, decreasing the pressure in the refining vessel to 150–20 Torr, and using only the non-oxidizing gas as the blowing gas in the amount of 0.2–0.5 $Nm^3$/min. per ton-steel under vacuum.

The second embodiment comprises: decarburizing by blowing mixed gas of a non-oxidizing gas and oxygen as the blowing gas under atmospheric pressure until the carbon concentration in the molten steel decreases to 0.15% (by weight), and after the carbon concentration decreased below this value, adding a reducing agent in more than the theoretical amount necessary for reducing chromium oxides in the molten steel, decreasing the pressure in the refining vessel to 150–20 Tort, and using only the non-oxidizing gas as the blowing gas in the amount of 0.2–0.5 $Nm^3$/min. per ton-steel under vacuum.

The third embodiment comprises: decarburizing by blowing mixed gas of a non-oxidizing gas and oxygen as the blowing gas under atmospheric pressure until the carbon concentration in the molten steel decreases to 0.15% (by weight), and after the carbon concentration decreased below this value, adding a reducing agent in more than the theoretical amount necessary for reducing chromium oxides in the molten steel, decreasing the pressure in the refining vessel to 150–20 Torr, and using only the non-oxidizing gas as the blowing gas in the amount of 0.2–0.5 $Nm^3$/min. per ton-steel under vacuum.

In either of the embodiments, as the non-oxidizing gas to be mixed with $O_2$ and blown under atmospheric operation inert gas such as Ar and He as well as $N_2$ may be used. The ratio of $O_2$ to the non-oxidizing gas in the mixed gas is preferably high in the initial stage of blowing so that the decarburization reaction may be promoted, and as the decarburization proceeds and C-concentration decreases, it is preferable to lower the ratio of $O_2$ to the non-oxidizing gas, i.e., the percentage of the non-oxidizing gas is gradually increased.

The method of refining chromium-containing molten steel according to the present invention which achieves the above mentioned second major object and the additional object comprises, in decarburization in which gases are blown into the chromium-containing molten steel in a refining vessel through a tuyere installed at the bottom of the refining vessel, decarburizing by blowing mixed gas of a non-oxidizing gas and oxygen as the blowing gas under atmospheric pressure until the carbon concentration in the molten steel decreases to 0.15% (by weight), and after the carbon concentration decreased below this value, decreasing the pressure in the refining vessel to 150–20 Torr, continuously adding a reducing agent in the theoretical amount necessary for reducing chromium oxides in the molten steel or more, and using only the non-oxidizing such as $N_2$ or other gas as the blowing gas in the amount of 0.2–0.5 $Nm^3$/min. per ton-steel under vacuum.

It is preferable to practice this embodiment of the invention by blowing $N_2$ as the non-oxidizing gas at the initial stage of the vacuum refining, and a non-oxidizing gas other than $N_2$ such as Ar for the vacuum treatment.

BRIEF EXPLANATION OF THE DRAWINGS

FIG. 2 is a graph showing the relation between Si-addition index and O-concentration in the chromium-containing molten steel;

FIG. 3 is a graph showing the relation between Si-addition index and decarburization reaction volume coefficient, Kc;

DETAILED EXPLANATION OF THE PREFERRED EMBODIMENTS

Figure 1:
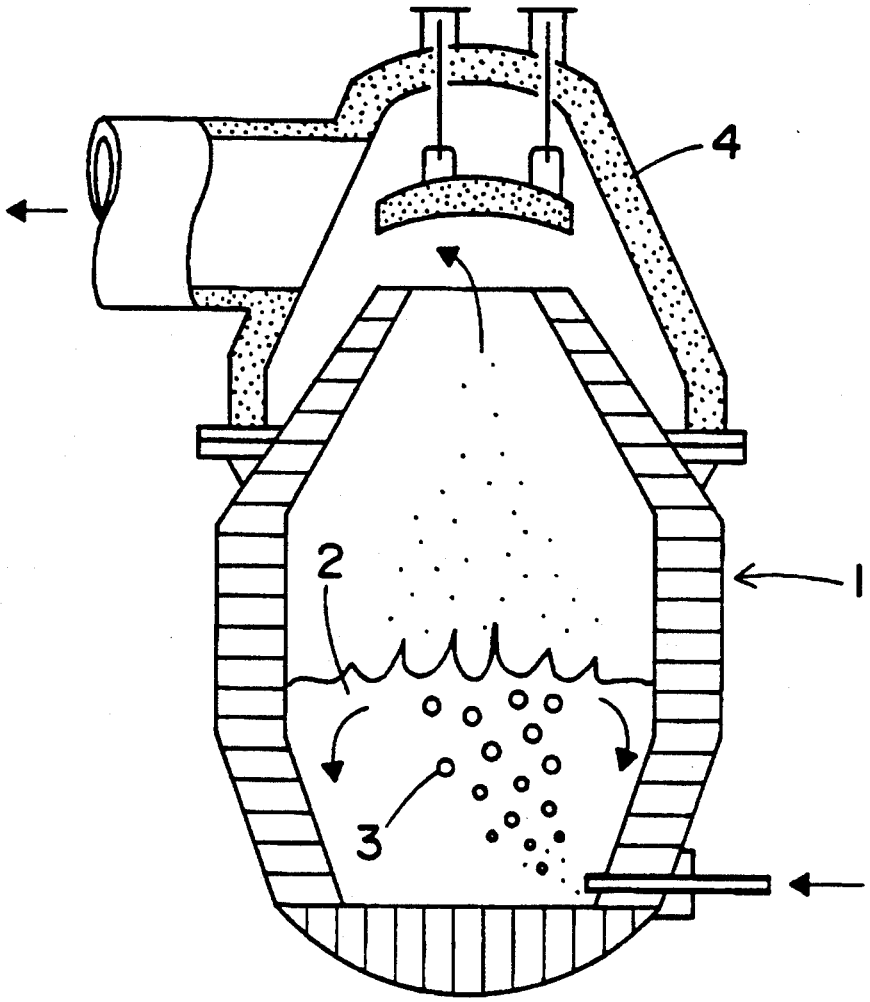
FIG. 1 is a cross sectional view of a refining vessel for explanation of the present invention.
Figure 4:
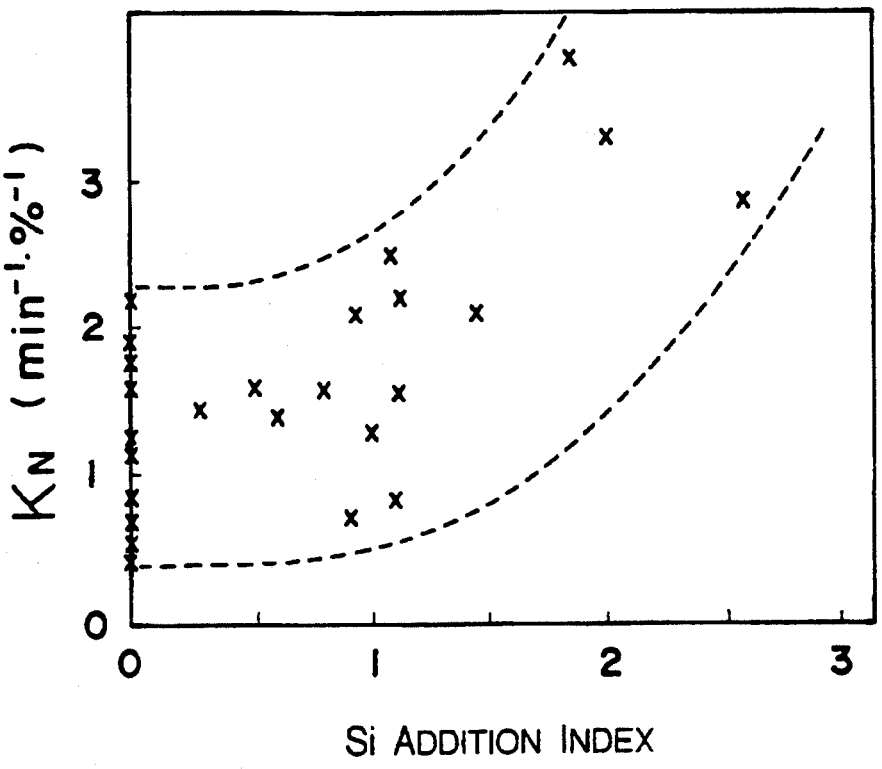
FIG. 4 is a graph showing the relation between Si-addition index and denitration reaction volume coefficient, KN.

When a mixed gas of $O_2$ and a non-oxidizing gas is blown into a molten steel (2) in a refining vessel (1) through a tuyere (5) as shown in FIG. 1, the molten steel is subjected to stirring by gas (3), and during blowing decarburization by $O_2$ proceeds. After the C-concentration decreased to 0.15% or less by the refining under atmospheric pressure, supply of $O_2$ is finished while non-oxidizing gas is blown and refining is continued under vacuum.

The reason why the refining condition is switched at the point where C-concentration decreased to 0.2% or less is that, if blowing the mixed gas of $O_2$ and non-oxidizing gas is continued into a chromium-containing molten steel with C-concentration of 0.15% or so under atmospheric pressure, then loss of Cr by oxidation increases without efficient decarburization.

In the first embodiment of the invention a reducing agent such as metallic silicon and ferrosilicon is added to the chromium-containing molten steel in which C-concentration decreased to 0.15% or less. The amount of addition is the theoretical amount necessary for reducing all the chromium oxides or less, i.e., the reducing agent is added in such amount that Si-addition index is up to 1.0.

The chromium oxides (such as $Cr_2O_3$) formed during preceding steps and contained in the slag are reduced by Si-component in the reducing agent through the reaction below:

$$2\ Cr_2O_3 + 3\ C \text{—} 4\ Cr + 3\ SiO_2$$

and the resulting Cr is dissolved in the chromium-containing molten steel.

As mentioned above, if vacuum is applied at a C-concentration of 0.2–0.4%, a large CO gas occurs (maybe due to the reaction: $Cr_2O_3 + C \text{—} 3\ CO + 2\ Cr$) and it is feared that the gas react $O_2$ to cause explosion in the upper space of the refining vessel or in an exhaust gas duct. Of course it is absolutely necessary to prevent explosion for ensuring safety of the workers and avoiding damages of the apparatus. Thus, application of vacuum is conducted preferable at a C-concentration of 0.15% or less, because there is substantially no danger of explosion.

At the vacuum refining the molten steel is vigorously stirred by the blown gas under the condition that loss of Cr by oxidation in the chromium-containing molten steel is suppressed because the blown gas is non-oxidizing, and Cr-oxides react the added reducing agent.

By reaction (1) $SiO_2$ occurs in the slag and lowers the melting point of the slag and increases fluidability thereof. As the result, the slat is easily mixed with the chromium-containing molten steel which is being stirred by the blown gas and the contacting area between the fluidized slag and the molten steel increases. The chromium oxides in the slag is reduced in accordance with the above formula (1) and at the same time, by carbon contained in the chromium-containing molten steel in accordance with the formula below:

$$Cr_2O_3 + 3\ C \text{—} 2\ Cr + 3\ CO \qquad (2)$$

The reaction of formula (2) is, from the view point of the chromium-containing molten steel, a decarburization reaction.

The reactions of formulas (1) and (2) simultaneously proceed and thus, decarburization of the chromium-containing molten steel efficiently proceeds.

In order to promote the reactions shown by the formulas (1) and (2), it is useful to effectively mix and stir the chromium-containing steel and the low melting point slag, and to lower the partial pressure of formed CO, and therefore, the higher the extent of reduction of pressure and the vacuum refining the more preferable. In fact, because reduction of Cr-oxides by C-component in the molten steel or decarburization and Cr-recovery are not promoted at the pressure in the range of 300 to 200 Torr, it is necessary to reduce the pressure to such level as lower than 200 Torr, particularly, 150 Torr of less. On the other hand, extreme vacuum suction causes, as mentioned above, splashing due to sudden generation of CO, and it is recommended to choose suction to a suitable reduction of pressure. The lower limit, 20 Torr, was determined due to the reason that the splashing is in the limit that is practically permissible.

The amount of the non-oxidizing gas blown during the vacuum refining should be, from the view point to ensure stirring energy for decarburization, as high as possible, and 0.2 $Nm^3$/min per ton-steel is necessary. However, because the operation is under vacuum, extremely large amount is not necessary to blow. Also, too much amount of blown gas causes difficulty of splashing of the molten steel. In order to limit the splashing to a permissible extent, it is necessary to limit the amount of blown gas up to 0.5 $Nm^3$/min. per ton-steel.

In the second embodiment, after addition of a reducing agent in such amount that the Si-addition index is 1.0 or higher, blowing non-oxidizing gas under a reduced pressure is carried out as done in the first embodiment, and thus, at the same time of progress of decarburization according to the formula mentioned above, there proceeds deoxidation of the chromium-containing molten steel by the silicon component which is added in an excess quantity. As the result, denitration reaction occurs due to decrease of oxygen which is a surface active element. Thus, in accordance with the second embodiment, a high-Cr steel of low-C and low-N can be produced.

It can be said that the third embodiment is a method in which the first embodiment and the second embodiment are sequentially done. The third embodiment is the embodiment in which, after change of the refining condition to vacuum operation and switching of the blown gas to non-oxidizing gas only, reducing agent is gradually added to the molten steel until Si-addition index exceeds 1.0.

In the former half of the process or the step in which Si-addition index is up to 1.0, effective decarburization reaction proceeds preferentially, and in the latter half of the process or the step in which Si-addition index is higher than 1.0, deoxidation reaction proceeds, and following this, denitration reaction proceeds effectively.

It is generally anticipated that, if nitrogen gas is blown into a molten steel during refining, nitration occurs. However, in case where the nitrogen content in the molten steel is in such a level as 1,500 ppm or higher, blowing $N_2$ gas under a vacuum of 20 Torr or less results in denitration. Therefore, it is possible to use $N_2$ gas instead of expensive Ar gas. Nevertheless, effect of denitration by blowing $N_2$ gas is limited to a certain extent, and it is practically preferable to finish refining operation by, after blowing a certain amount of $N_2$ gas, blowing Ar gas. In this case timing of switching the blowing gas from $N_2$ to Ar may be controlled so as to obtain a steel of desired N-content.

A reason for determining the switching point of the refining condition from atmospheric pressure to vacuum at C-content of 0.15% is that, if the C-content decreases to a level lower than 0.2%, decarburization with $O_2$ becomes less effective, while loss of Cr by oxidation increases, and this tendency becomes more remarkable around the C-content of 0.15

Another reason is for ensuring safety of the operation. As mentioned above, if vacuum is applied at the level of C-content of 0.2–0.4%, a large amount of CO gas evolves and explosion may occur. If the C-content becomes to 1.5% or lower, danger of explosion substantially disappears.

Even in this aspect, extent of vacuum should be more than 200 Torr, particularly, 150 Torr or less. On the other hand, extreme vacuum suction is not preferable as noted above. Thus, the lower limit of 20 Torr was decided.

By controlling the timing and the amount of reducing agent in accordance with the present method, it is possible to produce a low carbon or low carbon and low nitrogen steel in a short period of refining. Because of the shorter period of refining consumption of expensive Ar can be reduced, and thus, production of a chromium-containing steel of extremely low carbon content is realized with lower costs.

In case of vacuum treating the chromium-containing steel using N2 gas instead of at least a portion of Ar gas, it is further possible to reduce consumption of the expensive Ar gas, and the N-content of the chromium-containing steel can be regulated to desired level.

EXAMPLES

Example 1

Using the refining vessel (1) on which a vacuum hood (4) is installed to enable vacuum suction form the refining furnace of the structure shown in FIG. 1, there was carried out decarburization refining of a chromium-containing molten steel containing C: 1.20%, N: 0.04% and Cr: 18.2%.

Operation under the atmospheric pressure was conducted for 20 minutes with varying $O_2$/Ar ratio in the blown gas from 6/1, them 3/1 and to 1/1. By this decarburization, the Cr-concentration decreased to 0.15%, and the Cr-content, to 17.2%. N-content was 0.15%.

Metallic silicon was added at Si-addition index of 0.8. Operating condition was altered to a reduced pressure of 30 Torr and the blown gas was switched to Ar at a rate of 0.3 Nm3/min.ton-steel, and the refining was continued for 10 minutes. The obtained chromium-containing molten steel contained C: 0.005%, N: 0.05% and Cr: 18.00%.

At the last stage the refining conditions was put back to 760 Torr and stirring the molten steel with Ar of the above flow rate was continued for 5 minutes. The resulting chromium-containing molten steel contained C: 0.005%, N: 0.04% and Cr: 18.20%.

Example 2

A mixed gas of $O_2$ and $N_2$ was blown into a chromium-containing molten steel containing C: 1.20%, N: 0.04% and Cr: 18.20% under 760 Torr or atmospheric pressure for 20 minutes. The $O_2/N_2$ ratio (by volume) in the mixed gas was altered in three stages as 6/1 - 3/1 -- 1/1. The resulting chromium-containing molten steel contained C: 0.15 N: 0.15% and Cr: 17.20%. There was observed oxidation loss of Cr at the same time of decarburization.

Then, metallic silicon was added at a Si-addition index of 2.0, and the refining condition was altered to 30 Torr vacuum. The resulting chromium-containing molten steel contained C: 0.003%, N: 0.025% and Cr: 18.20%.

Example 3

A mixed gas of $O_2$ and N2 was blown into a chromium-containing molten steel containing C: 1.20%, N: 0.04% and Cr: 18.20% under 760 Torr or atmospheric pressure for 20 minutes. The $O_2/N_2$ ratio (by volume) in the mixed gas was altered in three stages as 6/1 - 3/1 -- 1/1. The resulting chromium-containing molten steel contained C: 0.15 N: 0.15% and Cr: 17.20%. There was observed oxidation loss of Cr at the same time of decarburization.

Then, the refining condition was altered to 30 Torr vacuum and the blown gas was switched to Ar at the flow rate of 0.3 $Nm^3$/min.ton-steel. Metallic silicon was gradually added at a Si-addition index of 2.0 over 10 minutes. The resulting chromium-containing molten steel was an extremely low carbon and extremely low nitrogen steel containing C: 0.005%, N: 0.025% and Cr: 18.20%.

Example 4

Using the refining vessel (1) of the structure shown in FIG. 1, there was carried out decarburization refining of a material for 18Cr-SNi (SUS 304) stainless steel by blowing gas (3) into the molten steel (2).

Operation under the atmospheric pressure was conducted for 20 minutes with varying $O_2$/Ar ratio in the blown gas from 6/1, them 3/1 and to 1/1. By this decarburization, the Cr-concentration decreased to 0.15%, and the Cr-content, to 17.2%.

Then, the blown gas was switched to $N_2$ only (flow rate: 0.3 $Nm_3$/min.ton-steel) and stirring was continued. A lid was set on the vessel to keep it airtight and vacuum suction was applied to reduce the pressure in the vessel to 30 Torr.

Figure 5:
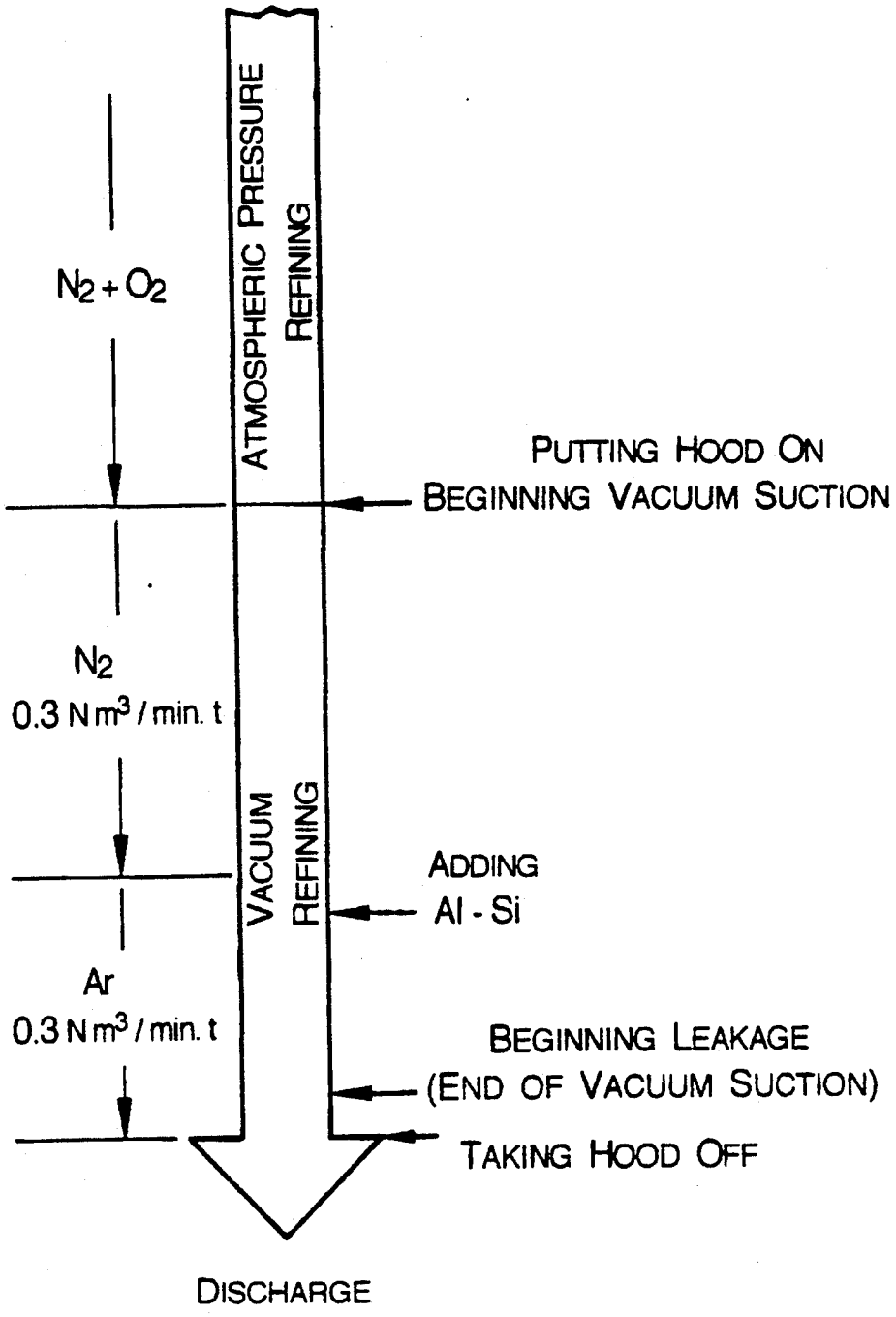
FIG. 5 is a scheme showing flow of the refining process of an example of the present method.

The period of the vacuum refining was 10 minutes in total, and in the middle of the operation, the blown gas was changed from N2 to Ar. The scheme of whole the refining process is as shown in FIG. 5. Around switching of the blown gas ferrosilicon was added to to reduce the chromium oxides. The addition was made in such amount that is somewhat excess of the theoretical amount of complete reduction of the chromium oxides.

Figure 6:
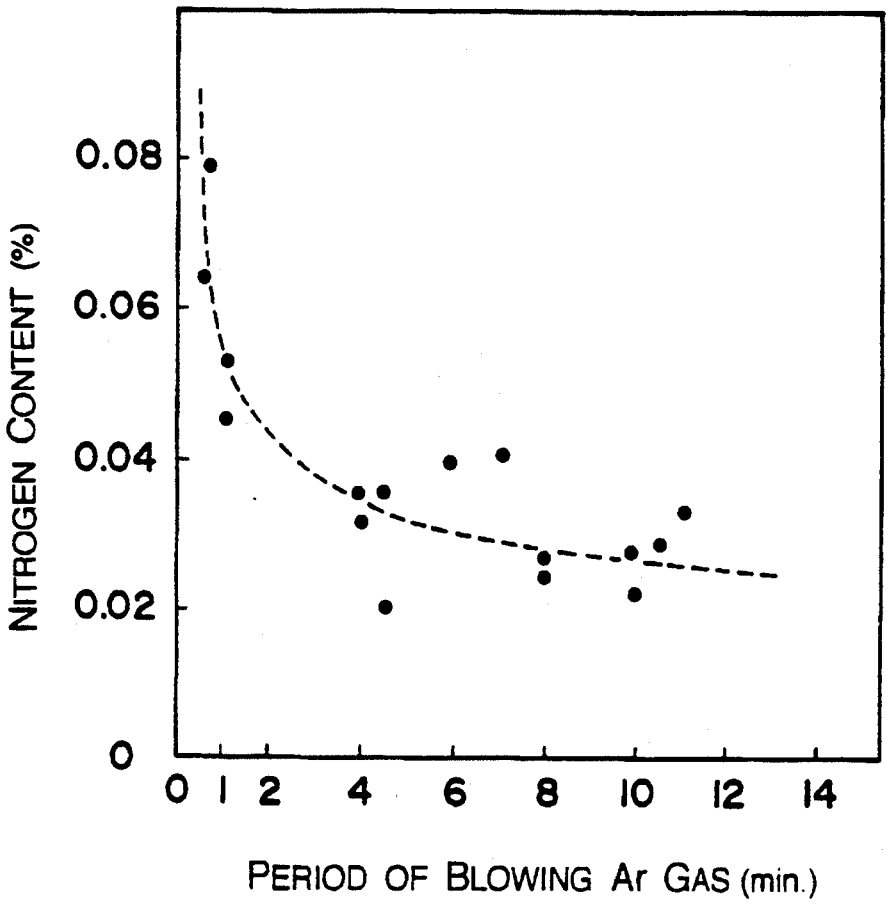
FIG. 6 shows the data of the present method as a graph showing the relation between the Ar gas blowing period and the N-content in the molten steel.

Under various periods of blowing Ar gas N-contents in the obtained molten steel were measured. the results are shown in FIG. 6. From the graph of FIG. 6, it is seen that, in case where the period of blowing Ar gas was up to one minutes, N-content is 500 ppm or more, while in case where the blowing is done for more than one minutes, then the N-content decreases to a lower level of 400–200 ppm. Thus, it is concluded that the timing of switching the blown gas form $N_2$ to Ar may be decided on the basis of the desired N-content.

C-contents in these steels were 0.01–0.05%.

Example 5

As the object of the refining materials for 13Cr steel and 24Cr-13Ni steel were used in addition to the above 18Cr-8Ni (SUS 304) stainless steel, and decarburization refining under atmospheric pressure was carried out as described in Example 4.

In the subsequent vacuum refining the timing of switching the blown gas from N2 to Ar and the amount of Ar gas consumed during the vacuum treatment were varied as shown below:

| | Timing of Switching (the Blown Gas $N_2$–Ar) | Amount of Ar Gas Used (Nm3/ton-molten steel) |
|---|---|---|
| A | at the beginning of vacuum suction | 2 |
| B | in the vacuum treatment | 1 |
| C | after completion of vacuum treatment | 0 |

Analysis was made on the N-contents in the steels which were obtained from the above three materials by vacuum refining A–C noted above. The results are as follows (unit is weight %):

| Object of Refining | Embodiments of Vacuum Treatment | | |
|---|---|---|---|
| | A | B | C |
| 13Cr—8Ni | 0.024 | 0.036 | 0.049 |
| 13Cr | 0.016 | 0.024 | 0.033 |
| 24Cr—13Ni | 0.036 | 0.058 | 0.078 |

We claim:

1. A method of refining chromium-containing steel by blowing gas into the molten steel in a refining vessel through a tuyere installed at the bottom of the vessel for decarburization, comprising: blowing mixed gas of a non-oxidizing gas and oxygen under atmospheric pressure until the carbon concentration in the molten steel decreases to 0.15% (by weight) or less, and after the carbon concentration decreased below this value, adding a reducing agent in an amount equal to or less of the theoretical amount necessary for reducing chromium oxides in the molten steel, decreasing the pressure in the refining vessel to 150–20 Torr, and using only the non-oxidizing gas as the blown gas in an amount of 0.2–0.5 $Nm^3$/min. per ton-steel under vacuum.

2. A method of refining chromium-containing steel by blowing gas into the molten steel in a refining vessel through a tuyere installed at the bottom of the vessel for decarburization, comprising: blowing mixed gas of a non-oxidizing gas and oxygen under atmospheric pressure until the carbon concentration in the molten steel decreases to 0.15% (by weight) or less, and after the carbon concentration decreased below this value, adding a reducing agent in an amount equal to or more of the theoretical amount necessary for reducing chromium oxides in the molten steel, decreasing the pressure in the refining vessel to 150–20 Torr, and using only the non-oxidizing gas as the blown gas in an amount of 0.2–0.5 $Nm^3$/min. per ton-steel under vacuum.

3. A method of refining chromium-containing steel by blowing gas into the molten steel in a refining vessel through a tuyere installed at the bottom of the vessel for decarburization, comprising: blowing mixed gas of a non-oxidizing gas and oxygen under atmospheric pressure until the carbon concentration in the molten steel decreases to 0.15% (by weight) or less, and after the carbon concentration decreased below this value, decreasing the pressure in the refining vessel to 150–20 Torr, using only the non-oxidizing gas as the blown gas in an amount of 0.2–0.5 $Nm^3$/min. per ton-steel under vacuum, while adding a reducing agent continuously or continually to such amount that the total amount of the reducing agent exceeds the theoretical amount necessary for reducing chromium oxides in the molten steel.

4. A method of refining chromium-containing steel by blowing gas into the molten steel in a refining vessel through a tuyere installed at the bottom of the vessel for decarburization, comprising: blowing mixed gas of a non-oxidizing gas and oxygen under atmospheric pressure until the carbon concentration in the molten steel decreases to 0.15% (by weight) or less, and after the carbon concentration decreased below this value, decreasing the pressure in the refining vessel to 150–20 Torr further blowing a non-oxidizing gas selected from $N_2$ and the above non-oxidizing gas in an amount of 0.2–0.5 $Nm^3$/min. per ton-steel under vacuum, while adding a reducing agent continuously or continually in an amount equal to or more of the amount necessary for reducing chromium oxides in the molten steel.

5. A method of refining chromium-containing steel according to claim 4, wherein $N_2$ is blown as the non-oxidizing gas at the initial stage of the vacuum refining and a non-oxidizing gas other than $N_2$ in the latter stage of the vacuum refining.

* * * * *